United States Patent [19]

Klingel

[11] Patent Number: 4,555,966

[45] Date of Patent: Dec. 3, 1985

[54] PUNCH PRESS WITH MULTITOOL PUNCH ASSEMBLY

[75] Inventor: Hans Klingel, Moglingen, Fed. Rep. of Germany

[73] Assignee: Trumpf GmbH & Co., Ditzingen, Fed. Rep. of Germany

[21] Appl. No.: 647,419

[22] Filed: Sep. 5, 1984

Related U.S. Application Data

[63] Continuation-in-part of Ser. No. 546,745, Oct. 28, 1983.

[30] Foreign Application Priority Data

Nov. 6, 1982 [DE] Fed. Rep. of Germany ..... 3241046

[51] Int. Cl.[4] ..... B21D 28/02

[52] U.S. Cl. ..... 83/71; 83/221; 83/399; 83/549; 83/571; 234/113; 234/114; 234/117

[58] Field of Search ..... 83/549, 551, 552, 571, 83/71, 221, 399; 234/113–115, 117, 99

[56] References Cited

U.S. PATENT DOCUMENTS

| | | |
|---|---|---|
| 3,048,328 | 8/1962 | Bohaboy et al. . |
| 3,518,908 | 7/1970 | Daniels . |
| 3,600,998 | 8/1971 | Palmer . |
| 3,685,380 | 8/1972 | Daniels . |
| 4,091,700 | 5/1978 | Cloup . |
| 4,096,774 | 6/1978 | Kaufmann . |
| 4,136,592 | 1/1979 | Beatty . |
| 4,182,022 | 1/1980 | Kristiansson . |
| 4,220,062 | 9/1980 | Blanz . |
| 4,250,784 | 2/1981 | Bredow . |
| 4,250,785 | 2/1981 | Morishita et al. . |
| 4,341,137 | 7/1984 | Leitch et al. . |

FOREIGN PATENT DOCUMENTS

| | | |
|---|---|---|
| 83110194 | 5/1984 | European Pat. Off. . |
| 441599 | 3/1927 | Fed. Rep. of Germany . |
| 1652637 | 5/1970 | Fed. Rep. of Germany . |
| 1502721 | 10/1973 | Fed. Rep. of Germany . |
| 7736466 | 10/1978 | Fed. Rep. of Germany . |
| 1081820 | 9/1967 | United Kingdom . |

*Primary Examiner*—Frank T. Yost

[57] ABSTRACT

A punch press has a punching tool assembly removably coupled to the ram, and it carries a plurality of punching pins which are individually selectable for a punching operation. A rotatable cam moves the selected punch pin from a retracted position in the tool assembly to an operative punching position, and the cam is driven by a retractable drive mechanism which is movable into engagement with the rotatable cam to effect such rotation and retracted to an inoperative position, by a moving means. Control means is provided to effect operation of the moving means and of the drive mechanism, and is operable to effect precise rotation of the cam member.

20 Claims, 6 Drawing Figures

PUNCH PRESS WITH MULTITOOL PUNCH ASSEMBLY

RELATED APPLICATIONS

This application is a continuation-in-part of application Ser. No. 546,745 filed Oct. 28, 1983, entitled "Multitool Punch Mechanism".

FIELD OF THE INVENTION

This invention relates to punch presses and, more particularly, relates to punch presses with interchangeable tooling that perform punching, notching and contouring of holes in the workpiece.

BACKGROUND OF THE INVENTION

Punch presses of the type in which there are provided interchangeable punch and die assemblies are widely utilized to punch sheet metal to define individual cut-outs or particular patterns of cut-outs of apertures therein, and to nibble large contoured apertures. In such machines, the tooling may be changed manually (manual tool changer) or automatically from an indexable storage unit (automatic tool changer) with the punch being rigidly coupled to the punch press ram and the cooperating die supported in a cooperating die holder aligned beneath the punch.

The changing of the punches and dies may be effected relatively quickly in numerically controlled machines.

In the past, punch presses have used a punch assembly having one punch and one mating die in alignment with the ram, and this has required changing of the punch and die assembly whenever a different diameter or aperture configuration is required, or whenever the contour in a cut out is changing. Moreover, even in the automatic tool changer magazine, there is a limited number of punch assemblies which can be satisfactorily employed, and there are space considerations with respect to the size of the magazines and the automatic elements for effecting the changing of the tooling in the operative punch station.

In Applicant's copending application Ser. No. 546,745, filed Oct. 28, 1983, there is disclosed a multitool punch assembly where the punch tool assembly coupled to the ram and the cooperating die holder in the table or bed below the ram have a plurality of cooperating punch pins and dies, thereby increasing the number of punch pins available in the machine and avoiding the necessity for changing the tooling in registry with the ram.

Although punch presses employing this assembly have proven highly advantageous, there has been a need to provide an improved drive mechanism for engaging the multitool punch assembly in the punch station to rapidly change the punch pin in use and to facilitate insertion and removal of the assembly from the ram.

It is an object of the present invention to provide a new and improved punch press having coupled to the ram a multitool punch assembly which includes a multiplicity of punch pins which can be selectively moved from an inoperative position to an operative position by a drive mechanism which is rapidly and easily movable between a position in engagement with the punch assembly to effect such movement and an inoperative position.

Another object is to provide such a punch press utilizing a new and improved indexing and drive mechanism for the multitool punch assembly.

Another object is to provide such a punch press employing control means to ensure disengagement of the indexing drive mechanism during operation of the ram and during movement of the multitool punch assembly from and into engagement with the ram.

SUMMARY OF THE INVENTION

It has now been found that the foregoing and related objects can be readily attained in a punch press which includes a housing, a ram reciprocatably mounted in the housing, and a multitool punch assembly operatively coupled to the ram. The multitool punch assembly has a coupling member, a punch pin support member, and at least two punch pins disposed within bores in the support member and having a working end adapted to strike the associated workpiece. The pins are movable in the bores along axes parallel to the axis of reciprocation of the ram from an operative working position to an elevated inoperative position. A cam member in the multitool punch assembly is mounted for rotation about the support member, and the rotatable cam member has a cam surface thereon adapted to overlie the opposite ends of the punch pins in the support member upon rotation thereabout. As a result, the cam member moves a selected one of the punch pins from its retracted position to its working position, and the multitool assembly also includes means for returning a previously selected punch pin to its inoperative position.

The punch press also includes drive means in the housing which is engageable with the rotatable cam member for effecting rotation thereof to effect selection and movement of various punch pins in the multitool assembly, and means for moving the drive means into engagement with the rotatable cam member of the multitool punch assembly to effect rotation thereof and for retracting the drive means to an inoperative portion free from engagement with the cam member. Control means is effective to operate the moving means to move the drive means into engagement with the rotatable cam member and then to effect operation of the drive means to rotate the cam member to selectively move a punch pin into working position and then to operate the moving means to retract the drive means to its inoperative position.

In the usual embodiments of the invention, the rotatable cam member has a gear portion engageable with the drive means, and the drive means includes a drive pinion which engages and disengages the gear portion upon operation of the moving means. The gear portion of the rotatable cam member is desirably provided by gear teeth on the periphery thereof, and the moving means is mounted in the housing for movement perpendicularly to the axis of reciprocation of the ram. Usually, the press will include a support member mounted on the housing, and the drive means is slidably mounted on the support member.

Preferably, the punch pin returning means comprises springs normally biasing the punch pins to the inoperative position, and the cam member moves one of the punch pins to an operative position upon movement to an overlying position against the biasing action of such springs.

In the preferred embodiments, the drive means includes a train of gears including a drive pinion engageable with the cam member, a motor, and means coupling the motor to the gear train. The coupling means includes an elongated shaft having a universal coupling to the gear train and to a shaft driven by motor. The preferred motor is a stepper motor controlled by the control means to effect precise rotation of the rotatable cam member.

The multitool punch assembly is disengageable from the ram for removal therefrom, and the press includes means coupling the multitool punch assembly to the ram. The control means is operable to ensure operation of the moving means to maintain the drive means in its inoperative position during the removal from, and coupling to, the ram of the multitool punch assembly. Moreover, the control means is operable to ensure operation of the moving means to maintain the drive means in its inoperative position during reciprocation of the ram.

DETAILED DESCRIPTION OF THE PREFERRED EMBODIMENT OF THE INVENTION

Figures 1, 4:
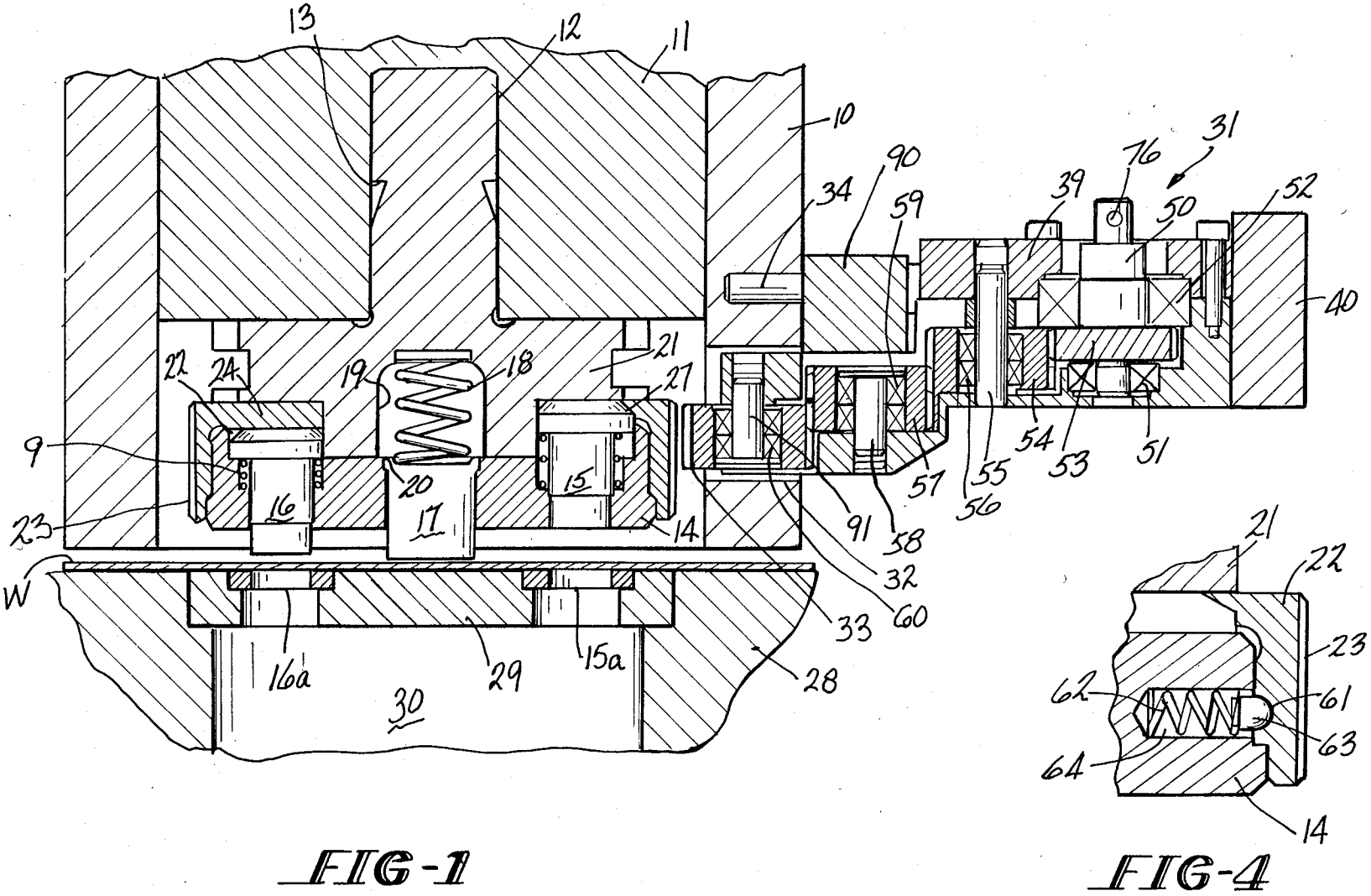
FIG. 1 is a fragmentary vertical section through a punch press at the punching station showing a multitool punch mechanism and gear indexing mechanism embodying the present invention.
FIG. 4 is a fragmentary sectional view of a portion of the multitool punch assembly of FIG. 1.

Turning first to FIG. 1 of the attached drawings, therein fragmentarily illustrated is a punch press embodying the invention and including a housing or head 10 having a ram 11 vertically reciprocatable therein. The ram 11 is driven by a conventional drive mechanism such as an eccentric (not shown). At the lower end of the ram 11 is a coaxial bore 12 which receives the locking pin 13 of the multitool punch assembly generally designated by the numeral 8. Locking pin 13, in operation, will be automatically locked rigidly to ram 11.

The multitool punch assembly 8 includes a punch pin carrier 14 which seats a multiplicity of punch pins exemplified by the numerals 15 and 16. Preferably, the carrier 14 will carry four or six punch pins. The general structure and principles of operation of the multitool punch assembly are described in detail in the aforementioned copending U.S. application Ser. No. 546,746 filed Oct. 28, 1983.

Disposed centrally in carrier 14 is a stripping element 17 biased downwardly by a spring 18 received in cavity 19, and the downward movement of stripper 17 is limited by an upper flange 20 abutting the mating seat in carrier 14.

The coupling member 21 on which the locking pin 13 is coaxially formed supports the carrier 14 by means of bolts (not shown). The punch pins 15 and 16 are biased upwardly by the springs 9 to a normally retracted and inoperative position, as exemplified by the showing of the pin 15.

Figure 2:
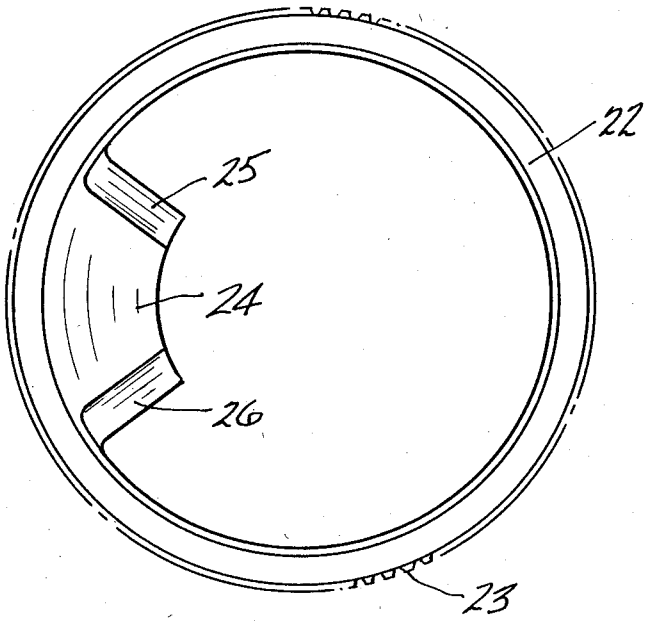
FIG. 2 is a bottom view of a cam gear utilized in the tool mechanism of FIG. 1 to selectively move the punch pins into their operative position.

Slidably supported on the carrier 14 between it and the coupling member 21 is a cam member 22 having gear teeth 23 formed about its periphery. Cam member 22, as more clearly shown in FIG. 2, has a cam surface 24 on the lower surface thereof adjacent its periphery which is arranged to overlie only one of the punch pins in any rotated or indexed position thereof. The underside of cam member 22 is seen in FIG. 2, the cam surface 24 at one sector of its periphery. Beveled edges 25 and 26 on the cam surface cooperate with the mating beveled surfaces 27 on the heads of the punch pins as seen in FIG. 1. Therefore, when cam member 22 is rotated, the bevelled edges 25 or 26 will slide along the bevelled surface 27 of the punch pins and cam downwardly a selected punch pin to an operative position, as exemplified by the punch pin 16 in FIG. 1.

As also shown in FIGS. 1, a workpiece W is on the bed 28 of the machine, and a die holder 29 is supported within the bed 28 below the workpiece W. The die holder 29 has die inserts (only two are shown) **15*a* and 16*a* seated in die receiving cavities therein and providing die openings which are dimensioned and configured to mate with the punches 15 and 16, respectively, in carrier 14. Parts which are punched or nibbled, as the case may be, from the workpiece W by the punch press fall into a collecting area designated by the reference numeral 30 beneath die holder 29**.

To effect rotation of the cam member 22 to a selected position, the punch press includes a retractable drive gear mechanism generally designated by the numeral 31. A drive pinion 33 in the drive gear mechanism 31 extends through a passage 32 in the housing 10. As illustrated in FIG. 1, the drive gear mechanism 31 is in its inoperative or retracted position with the pinion 33 disengaged and spaced from the gear teeth 23 on cam member 22.

Figure 3:
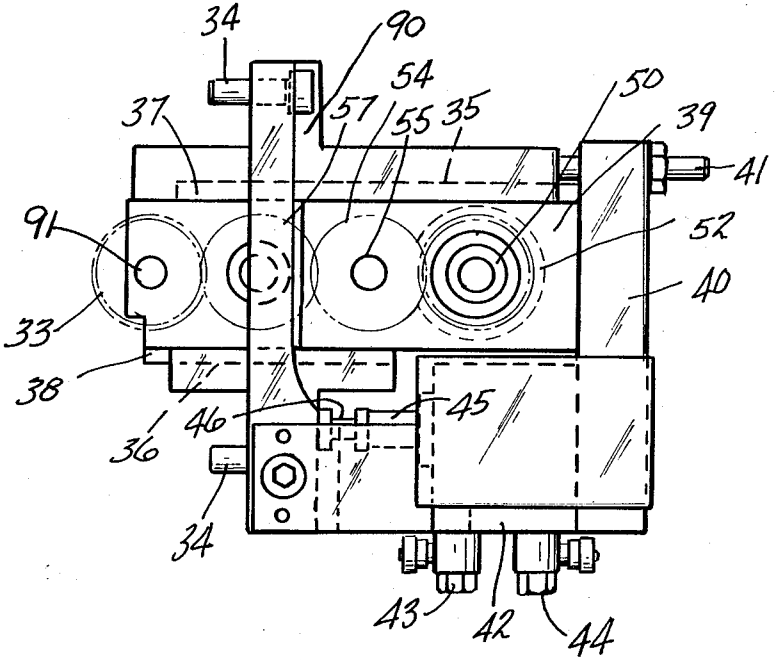
FIG. 3 is a top plan view of the gear indexing mechanism shown in section in FIG. 1.

The drive mechanism 31, as shown in FIGS. 1 and 3, includes a support member 90 which is secured to the housing 10 by means of a plurality of bolts 34. The support member 90 is configured to provide guideways 35 and 36 which receive flanges 37 and 38, respectively, on the gear train housing 39, which is slidable in the support member 90. A stop member 40 is mounted on the housing 39 and carries an adjustable stop bolt 41 arranged to abut support member 90 and define a limit position for the travel of the housing 39 during movement to its inoperative position.

The gear train housing 39 carries an air passage defining member 42 which seats nipples 43 and 44 and which provides conduits (not shown) leading to a double-acting air motor 45 mounted thereon. The air motor 45 includes a piston 46 which has a rod secured to the support member 90. The conduits in the member 42 extend to portions of the cylinder of the air motor 45 on opposite sides of the piston 46 for rapid operation to move the pinion 33 into engagement with the multitool punch assembly 8 or to move the pinion 33 and gear train housing 39 into the retracted, inoperative position illustrated in FIG. 1.

Referring further to FIG. 1, a shaft 50 is rotatably mounted in the gear train housing 39 by the bearings 51 and 52, and is coupled to a universal shaft as hereinafter described with respect to FIG. 5. The gear 53 secured to the shaft 50 is drivingly engaged with an idler gear 54 rotatably mounted on the shaft 55 by the bearings 56. A second idler gear 57 is drivingly engaged by the gear 54 and is rotatably mounted on the shaft 58 by bearings 59, and the idler gear 57 in turn is drivingly engaged with the drive pinion 33 which is rotatably mounted on the shaft 92 by the bearings 60. Thus, when shaft 50 is driven, drive pinion 33 will be rotated through the gears 53, 54 and 57.

Turning now to FIG. 4, proper positioning of the cam member 23 in an indexed position is ensured by detent assemblies. A multiplicity of equiangularly spaced detent recesses 61 are located in the inner sidewall of the cam member 22 in a precise angular position relative to the position of the cam surface 24. In the detent assembly, a spring 62 biases the plunger 63 outwardly of the recess 64 in which they are seated to engage in a detent recess 61. The number of recesses 64 and plungers 63 will normally be equal in number to the number of punch pins in carrier 14, and they are precisly located relative to the position of the punches to ensure that the cam surface 24 will overlie the punches.

Figures 5, 6:
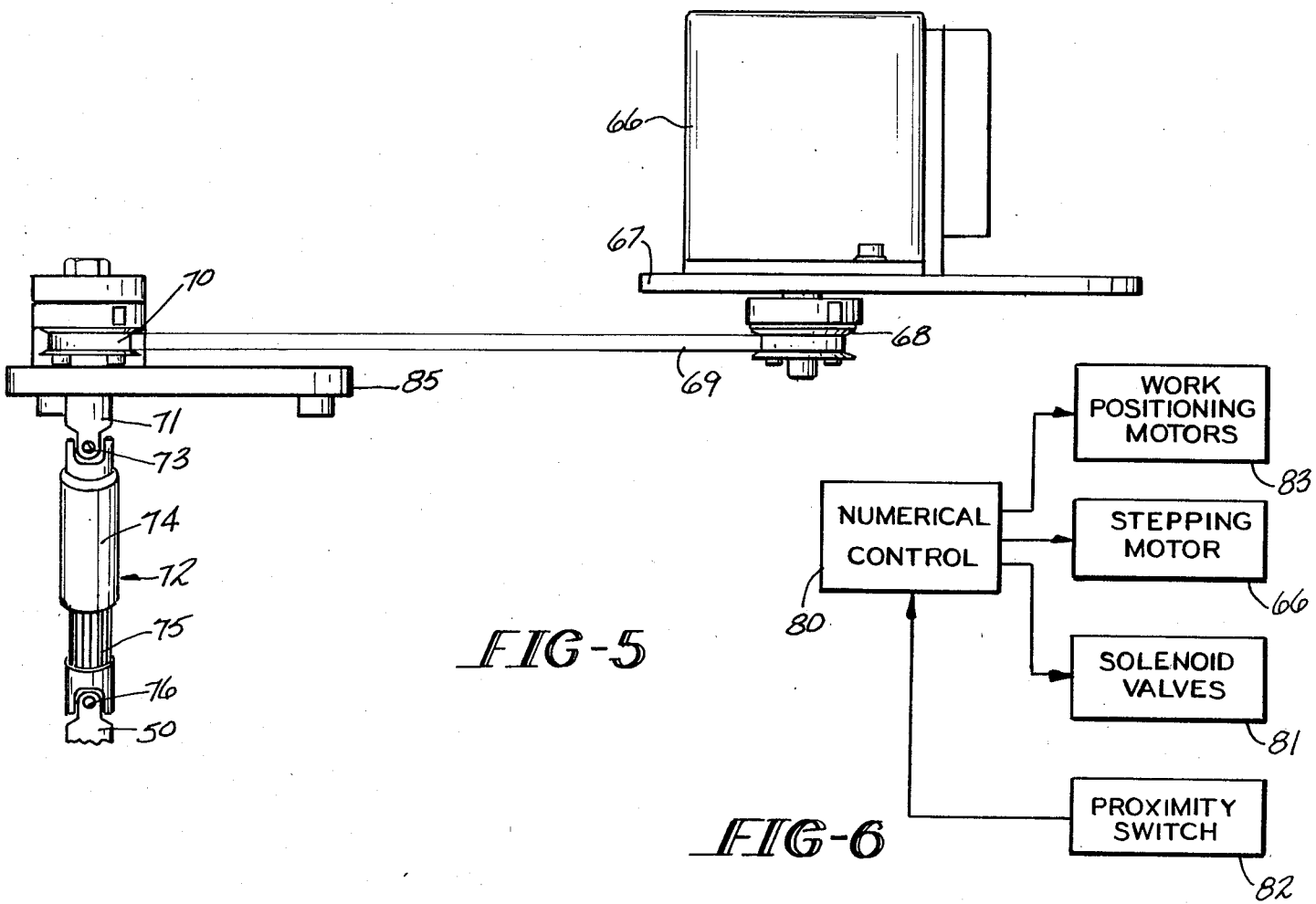
FIG. 5 is a side elevational view of the drive mechanism for the gear indexing mechanism of FIGS. 1 and 3.
FIG. 6 is a block diagram of the operative components to effect the indexing of the cam and selection of the punch pin within the multitool punch assembly.

Turning now to FIG. 5, a stepping motor 66 is mounted on a platform 67 mounted on the housing 10, and drives a pulley 68 having a timing belt 69 which extends about another pulley 70 rotatably mounted on another platform 85 supported on the housing 10. Rotatable with the pulley 70 is the shaft 71 which is pivotally connected to the universal shaft 72 by pivot pin 73. The universal shaft 72 includes a pair of internally splined end portions 74 which telescopically receive an externally splined intermediate portion 75 to permit elongation or reduction of the length of the shaft 72 as gear train housing 39 moves to provide engagement or non-engagement with the cam member 22. The pivot pin 76 provides a pivotable connection between the universal shaft 72 and the shaft 50 of the gear train.

In operation, the press will be operated to punch or nibble on a workpiece W by reciprocation of the ram 11 and its selected punch pin. The workpiece W will be moved and positioned on the bed 28 by a workpiece clamping assembly (not shown) and operated along X and Y axes on the bed 28 by a numerical control system represented by the reference numeral 80 in FIG. 6.

When it is desired to change the punch pin of the multitool punch assembly 8 which is extended for operation on the workpiece W, the air motor 45 is energized by the numeric control system 80 through air selectively supplied to one of the nipples 43, 44 by energizing the appropriate solenoid valve 81 to move the gear train housing 39 so that drive pinion 33 engages the gear teeth 23 on the cam member 22.

A proximity switch 82 is mounted on the drive gear mechanism 31 and housing 10 to signal the position of the gear train housing 39, i.e., retracted from or engaged with gear teeth 23. When a signal is returned to control 80 indicative of the drive pinion 33 being engaged with the gear teeth 23, the numeric control system 80 then operates the stepping motor 66 to rotate or index the cam member 22 to register the cam surface 24 over a predetermined punch pin to extend it into working position for operation upon the workpiece W.

After the desired indexing of the cam member 22, the other solenoid valve 81 is actuated to cause the air motor 45 to retract the gear train housing 39. The press is then ready for operation to continue punching or nibbling of the workpiece W using the newly selected punch pin.

Thus, it can be seen from the foregoing detailed specification and drawings that punch presses embodying the present invention provide multitool punch assemblies which are readily indexable to render operational a selected punch pin by a drive gear mechanism which is readily movable between operative and retracted positions. The control system for the press actuates the drive gear mechanism and its associated drive mechanism to effect the desired indexing when the drive gear mechanism is engaged, and the drive gear mechanism is thereafter moved to its retracted position which does not interfere with operation of the ram or the mounting on and removal from the ram of the multitool punch assembly or other punches.

Having thus described the invention, what is claimed is:

1. In a punch press, the combination comprising:

A. a housing;

B. a ram reciprocatably mounted in said housing; and

C. a multitool punch assembly operatively coupled to said ram, said assembly comprising:

(i) a coupling member, (ii) a punch pin support member, (iii) at least two punch pins disposed within bores in said support member and having a working end adapted to strike an associated workpiece and an opposite end, said pins being movable in said bores along axes parallel to the axis of reciprocation of said ram from an operative working position to an elevated inoperative position, (iv) a cam member mounted for rotation about said support member, said rotatable cam member having a cam surface thereon adapted to overlie said opposite end of any one of said punch pins in said support member upon rotation thereabout, said cam member moving a selected one of said punch pins from its retracted position to its working position, and (v) means for returning previously selected punch pins to its inoperative position;

D. drive means in said housing engageable with said rotatable cam member for effecting rotation thereof to effect selection and movement of various punch pins in said multitool assembly;

E. means for moving said drive means into engagement with said rotatable cam member of said multitool punch assembly to effect rotation thereof and for retracting said drive means to an inoperative portion free from engagement with said cam member; and F. control means for operating said moving means to move said drive means into engagement with said rotatable cam member and then to effect operation of said drive means to rotate said cam member to selectively move a punch pin into working position and then to operate said moving means to retract said drive means to its inoperative position.

2. The punch press of claim 1 wherein said rotatable cam member has a gear portion engageable with said drive means.

3. The punch press of claim 2 wherein said drive means includes a drive pinion which engages and disengages said gear portion upon operation of said moving means.

4. The punch press of claim 1 wherein said returning means comprises springs normally biasing said punch pins to an inoperative position and said cam member moves one of said punch pins to an operative position upon movement to an overlying position against the biasing action of such springs.

5. The punch press of claim 1 wherein said rotatable cam member has gear teeth on the periphery thereof, wherein said drive means includes a pinion engageable with said teeth of said rotatable cam member, and wherein said moving means is mounted in said housing for movement perpendicularly to the axis of reciprocation of said ram.

6. The punch press of claim 5 including a support member mounted on said housing, and wherein said drive means is slidably mounted on said support member.

7. The punch press of claim 3 wherein said drive means includes a train of gears including said pinion, a motor, and means coupling said motor to said gear train.

8. The punch press of claim 7 wherein said coupling means includes an elongated shaft having a universal coupling to said gear train and to a shaft driven by said motor.

9. The punch press of claim 1 wherein said drive means includes a stepper motor controlled by said control means to effect precise rotation of said rotatable cam member.

10. The punch press of claim 1 wherein said multitool punch assembly is disengageable from said ram for removal therefrom and said press includes means coupling said multitool punch assembly to said ram, said control means being operable to ensure operation of said moving means to maintain said drive means in its inoperative position during the removal from, and coupling to, said ram of said multitool punch assembly.

11. The punch press of claim 1 wherein said control means is operable to ensure operation of said moving means to maintain said drive means in its inoperative position during reciprocation of said ram.

12. The punch press of claim 1 including a support member mounted on said housing, wherein said drive means is slidably mounted on said support member, wherein said rotatable cam member has a gear surface on its periphery, wherein said drive means includes a pinion engageable with said gear surface upon operation of said moving means, wherein said moving means moves said drive means in said housing in a direction perpendicular to the axis of reciprocation of said ram.

13. The punch press of claim 12 wherein said drive means comprises a train of gears including said pinion, a motor, and means coupling said motor to said gear train, said coupling means including an elongated shaft having a universal coupling to said gear train and to a shaft driven by said motor.

14. The punch press of claim 13 wherein said motor is a stepper motor controlled by said control means to effect precise rotation of said rotatable cam member.

15. In a punch press, the combination comprising:

A. a housing;

B. a ram reciprocatably mounted in said housing; and

C. a multitool punch assembly operatively coupled to said ram, said assembly comprising:

(i) a coupling member, (ii) a punch pin support member, (iii) at least two punch pins disposed within bores in said support member and having a working end adapted to strike an associated workpiece and an opposite end, said pins being movable in said bores along axes parallel to the axis of reciprocation of said ram from an operative working position to an elevated inoperative position, (iv) a cam member mounted for rotation about said support member, said rotatable cam member having a cam surface thereon adapted to overlie said opposite end of any one of said punch pins in said support member upon rotation thereabout, said cam member moving a selected one of said punch pins from its retracted position to its working position, and (v) means for returning previously selected punch pins to its inoperative position;

D. drive means in said housing engageable with said rotatable cam member for effecting rotation thereof to effect selection and movement of various punch pins in said multitool assembly, said cam member having a gear portion and said drive means including a drive gear engageable with said gear portion to effect rotation thereof;

E. a support member in said housing slidably supporting said drive means for movement in a direction perpendicular to the axis of reciprocation of said ram;

F. means for moving said drive means into engagement with said rotatable cam member of said multitool punch assembly to effect rotation thereof and for retracting said drive means to an inoperative portion free from engagement with said cam member; and G. control means for operating said moving means to move said drive means into engagement with said rotatable cam member and then to effect operation of said drive means to rotate said cam member to selectively move a punch pin into working position and then to operate said moving means to retract said drive means to its inoperative position, said control means is operable to ensure operation of said retracting means to maintain said drive means in its inoperative position during reciprocation of said ram.

16. The punch press of claim 15 wherein said drive means includes a train of gears including said drive gear, a motor, and means coupling said motor to said gear train, said coupling means including an elongated shaft having a universal coupling to said gear train and to a shaft driven by said motor.

17. The punch press of claim 16 wherein said motor is a stepper motor controlled by said control means to effect precise rotation of said rotatable cam member.

18. The punch press of claim 16 wherein said coupling means includes an elongated shaft having a universal coupling to said gear train and to a shaft driven by said motor.

19. The punch press of claim 15 wherein said returning means comprises springs normally biasing said punch pins to the inoperative position and said cam member moves one of said punch pins to an operative position upon movement to an overlying position against the biasing action of said springs.

20. The punch press of claim 15 wherein said gear portion comprises gear teeth on the periphery of said cam member and said drive gear is a pinion gear engageable therewith.

* * * * *